US009901177B1

(12) United States Patent
Ulrich

(10) Patent No.: US 9,901,177 B1
(45) Date of Patent: Feb. 27, 2018

(54) INFLATABLE CHAIR SYSTEM

(71) Applicant: Jonas Ulrich, Upland, CA (US)

(72) Inventor: Jonas Ulrich, Upland, CA (US)

( * ) Notice: Subject to any disclaimer, the term of this patent is extended or adjusted under 35 U.S.C. 154(b) by 0 days.

(21) Appl. No.: 14/088,428

(22) Filed: Nov. 24, 2013

(51) Int. Cl.
*A47C 4/54* (2006.01)

(52) U.S. Cl.
CPC ..... *A47C 4/54* (2013.01)

(58) Field of Classification Search
CPC ..... A47C 4/54; A47C 7/62; B60R 11/0235
USPC ..... 297/452.41, DIG. 3, 217.1, 217.3
See application file for complete search history.

(56) References Cited

U.S. PATENT DOCUMENTS

| | | | | |
|---|---|---|---|---|
| 7,735,931 | B1 * | 6/2010 | Weiner et al. | 297/452.41 |
| 2009/0085393 | A1 * | 4/2009 | Austen et al. | 297/452.41 |
| 2010/0123340 | A1 * | 5/2010 | Lin | 297/217.4 |
| 2010/0123347 | A1 * | 5/2010 | Lin | 297/452.41 |
| 2011/0089741 | A1 * | 4/2011 | Cyr | 297/452.41 |
| 2014/0021768 | A1 * | 1/2014 | Chen | 297/452.41 |

* cited by examiner

*Primary Examiner* — David R Dunn

(57) ABSTRACT

An inflatable chair system includes an inflatable body having at least one internal chamber that may be filled with air and a pump removably positioned inside the inflatable body. The pump couples to a battery such that the pump can be powered to inject air into the internal chamber. The inflatable body takes on the shape of a chair when filled with air.

7 Claims, 7 Drawing Sheets

INFLATABLE CHAIR SYSTEM

REFERENCE TO PRIORITY DOCUMENT

This application claims priority of U.S. Provisional Patent Application Ser. No. 61/803,210 entitled "INFLATABLE CHAIR SYSTEM" and filed on Mar. 19, 2013. Priority of the aforementioned filing date is claimed and the disclosure of the Provisional Patent Application is hereby incorporated by reference in its entirety.

BACKGROUND

The present disclosure relates to an inflatable seating device.

Most chairs are large and unwieldy and generally difficult to transport. Although collapsible chairs exist, they are usually made of rigid materials such as posts that fold along rigid hinges. As a result, conventional, collapsible chairs tend to be heavy and bulky even when in a folded state.

There exists a need for a chair that is sufficiently rigid to properly support a person in a seated position but that can also be collapsed into a small size that can easily be transported and carried.

SUMMARY

Disclosed is a chair that is inflatable from a small, compact size to a large, inflatable size. In one aspect, there is disclosed a chair system, comprising: an inflatable body having at least one internal chamber configured to be filled with air; and a pump removably positioned inside the inflatable body, the pump configured to be coupled to a battery such that the pump can be powered to inject air into the internal chamber; wherein the inflatable body takes on the shape of a chair when filled with air.

The details of one or more variations of the subject matter described herein are set forth in the accompanying drawings and the description below. Other features and advantages of the subject matter described herein will be apparent from the description and drawings, and from the claims.

BRIEF DESCRIPTION OF THE DRAWINGS

These and other aspects will now be described in detail with reference to the following drawings.

DETAILED DESCRIPTION

Before the present subject matter is further described, it is to be understood that this subject matter described herein is not limited to particular embodiments described, as such may of course vary. It is also to be understood that the terminology used herein is for the purpose of describing a particular embodiment or embodiments only, and is not intended to be limiting. Unless defined otherwise, all technical terms used herein have the same meaning as commonly understood by one skilled in the art to which this subject matter belongs.

Figure 1:
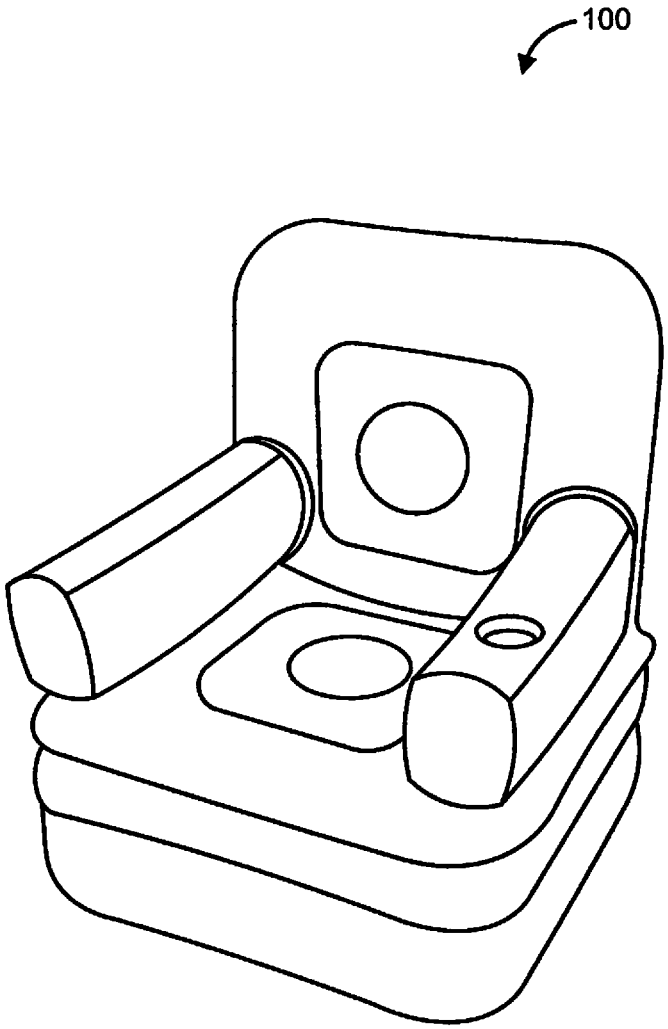
FIG. 1 shows a front, perspective view of an inflatable chair.

FIG. 1 shows a front view of an inflatable chair 100. The chair 100 has a seat that is sized and shaped for a person to sit on in a seated or inclined position. A pair of arm supports is positioned on opposed sides of the seat such that a person can rest his or her arms on the arm supports. A back is positioned behind the seat for supporting the torso of a person sitting on the chair. In an embodiment, the portion of the chair 100 that contacts a user when in use is covered with or is at least partially made of a material that is softer or otherwise more comfortable than the remainder of the chair.

It should be appreciated that the size and shape of the chair may vary. For example, the chair need not include arm supports and the relative positions of the back and the seat may vary to suit different seating positions and sizes.

The chair is made of a resilient and flexible material that may be filled with air. In an embodiment the chair is made of Poly(vinyl chloride) (PVC). The chair 100 is inflatable. The chair 100 includes one or more internal chambers that may be filled with air. When filled with air, the chair 100 has the shape shown in FIG. 1. The chair 100 can be filled to various internal inflation pressures that can be varied to adjust a level of support that the chair provides.

An inflation device (such as a pump) is removably coupled to the chair 100. In an embodiment, the inflation device is contained inside the chair within an internal chamber of the chair. In this manner, the inflation device is always available and is transported along with the chair whenever the chair is transported.

The inflation device can vary, and can be, for example, a manual or automatic pump. The inflation device may include a hose 707 (FIG. 7) or other device may be removably attached to a corresponding port 709 on the chair for injecting a sufficient amount of air into the internal chamber(s) of the chair. In an embodiment the pump is a battery powered pump. Alternately, the pump can be powered via an AC circuit. In another embodiment the pump is mounted inside the chair. The chair 100 can be filled or otherwise inflated with air so that it takes on the shape shown in FIG. 1.

Figure 2:
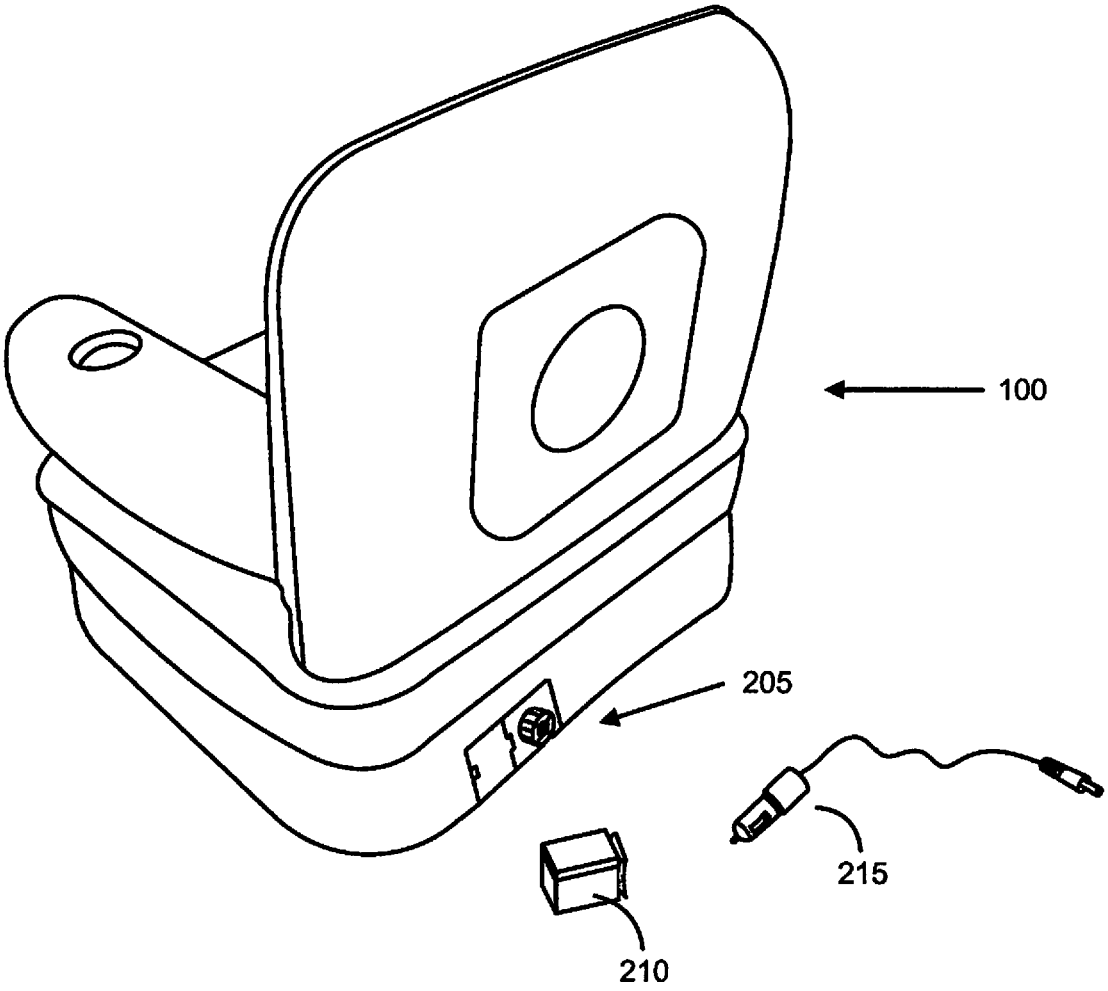
FIG. 2 shows a rear view of the chair.

FIG. 2 shows a rear view of the chair 100. In an embodiment, the chair 100 has a control panel 205 positioned on the chair, such as in a lower rear region of the chair. As discussed in detail below, the control panel 205 may include an actuator that permits the user to control an internal pump positioned inside the chair 100. The control panel 205 (or some other portion of the chair 100) may also include a port that is sized and shaped to couple to or receive a removable battery 210, as described in detail below. The removable battery 210 may be removably attached to a power cord 215 that can be plugged into a power outlet or other power station for charging the battery 210.

Figure 3:
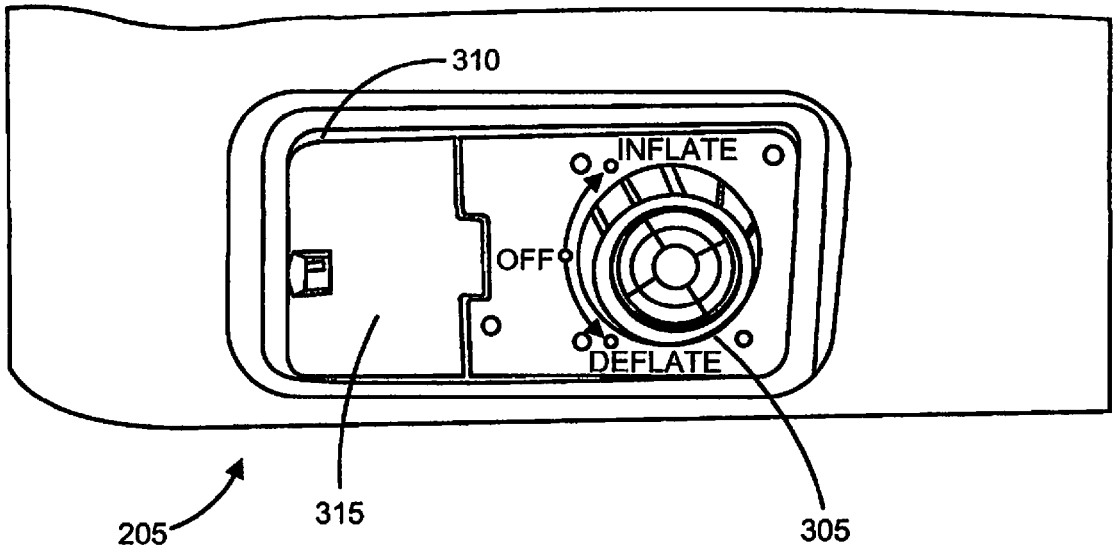
FIG. 3 shows an enlarged view of an inflation control panel of the chair.

FIG. 3 shows an enlarged view of the control panel 205. As mentioned, the control panel 205 includes an actuator 305 that is configured to control operation of the pump, which may be inside the chair. For example, the actuator 305 may be a knob that is rotatable between different positions, wherein a position controls operation or a state of the pump. In the illustrated embodiment, the positions include an "OFF" position wherein the pump is inactive, an "INFLATE" position wherein the pump is active in a manner that inflates the chair, and a "DEFLATE" position wherein the pump is active in a manner that evacuates air from and deflates the chair. Other positions of the actuator are possible and the actuator can be a mechanism other than a knob, such as button, touch screen, switch, etc.

The control panel may also include an opening or a valve that may be opened or otherwise actuated by a user for filling the chair with air manually and/or to assist with deflating the chair.

Figure 4:
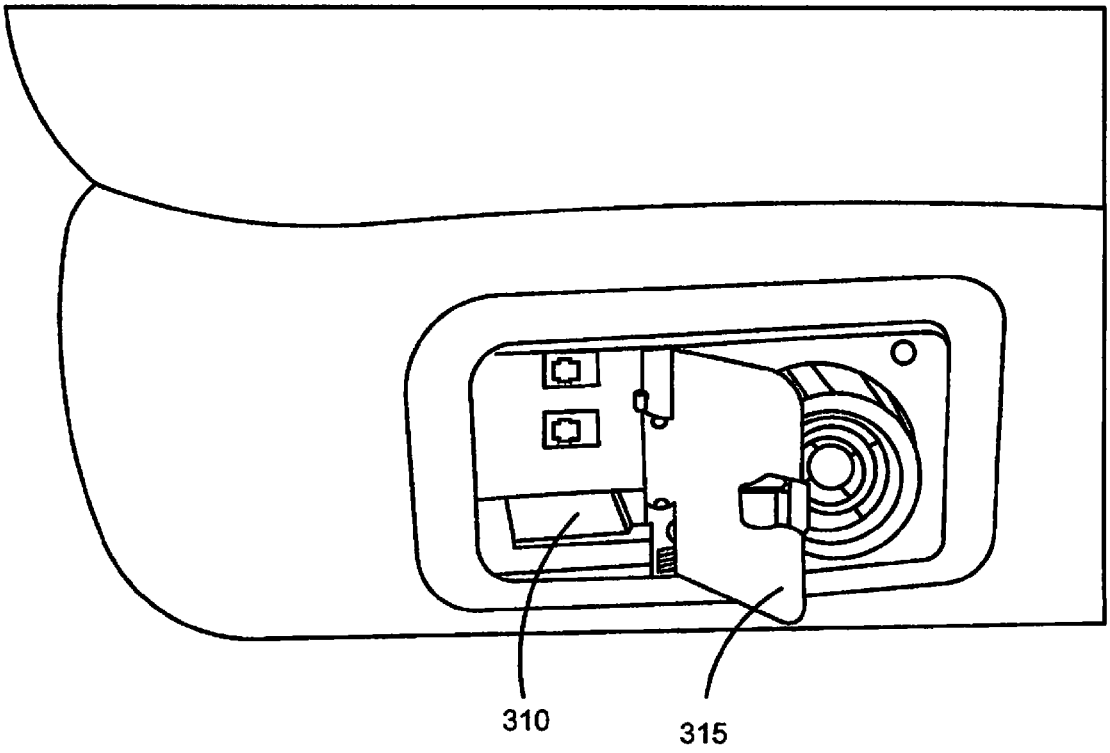
FIG. 4 shows the control panel with an opened battery port.

With reference still to FIG. 3, a battery port 310 is located on the control panel 205. The battery port 310 is a cavity that is sized and shaped to receive the removable battery. The battery port 310 includes a door 315 that can be opened and closed to provide access to the port 310 and to cover the port 310. FIG. 4 shows the battery port 310 with the door 315 opened and without the battery seated inside the batter port 310. The inside of the battery port 310 may include one or more electrical that couple to corresponding contacts on the removable battery for powering the pump.

Figure 5:
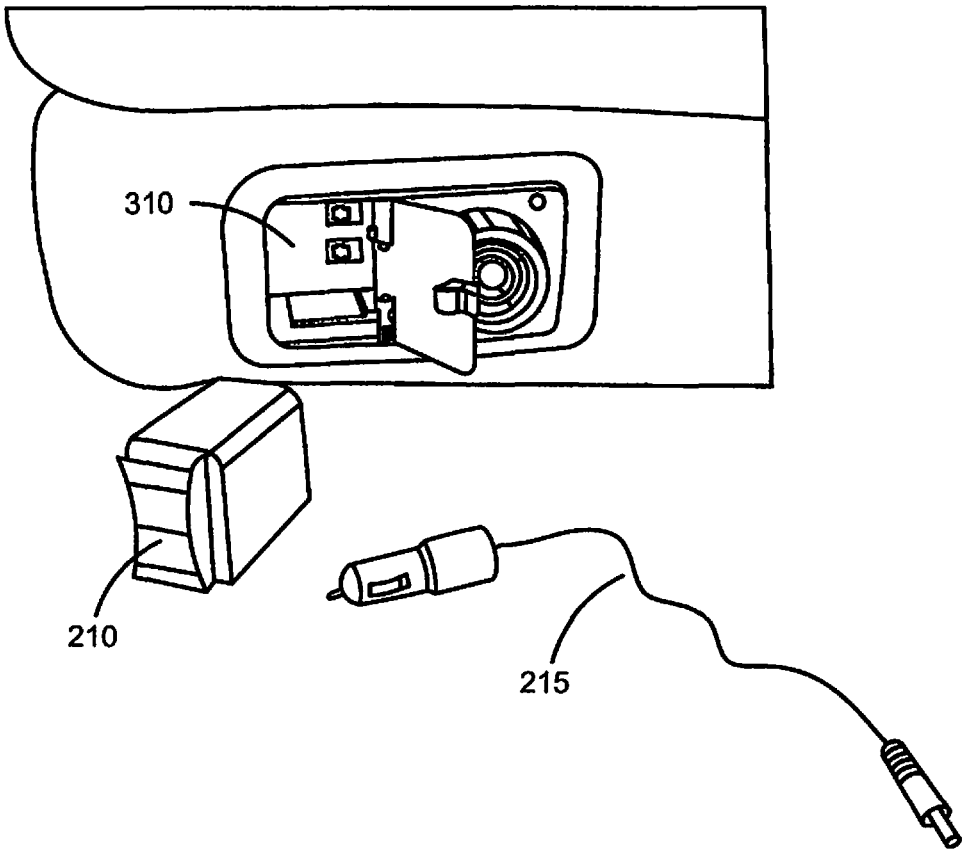
FIG. 5 shows a battery positioned adjacent the opened battery port.

FIG. 5 shows the battery 210 positioned adjacent the open battery port 310. As mentioned, the battery 210 is sized and shaped to fit inside the battery port 210 such that the door 315 may be closed with the battery 210 inside the battery port 210. This provides the control panel with a clean appearance when the door 315 is closed. The power or charging cord 305 is also shown in FIG. 5.

Figure 6:
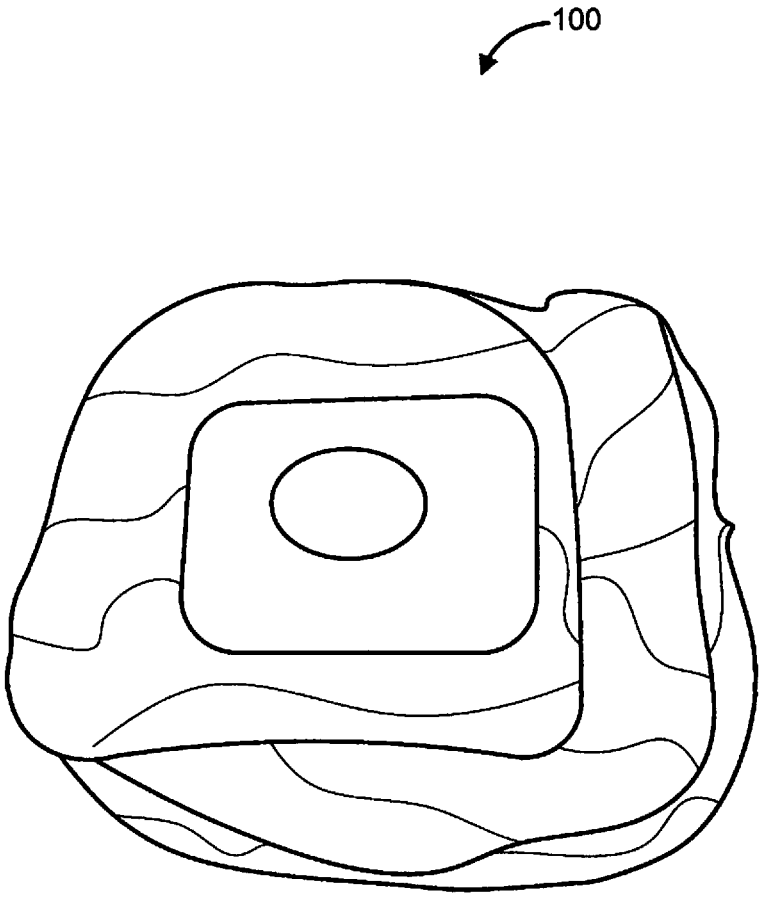
FIG. 6 shows the chair in a deflated state.

Once the chair 100 is inflated and after use, the air can be released from the chair such that the chair 100 can be collapsed and/or folded into a shape that can be easily stored or transported. FIG. 6 shows the chair 100 in a deflated state. Note that the size of the chair 100 is much smaller when deflated (FIG. 6) than when the chair 100 is inflated (FIG. 1). This makes the deflated chair 100 lighter and possibly easier for transport when deflated versus when the chair 100 is inflated.

Figure 7:
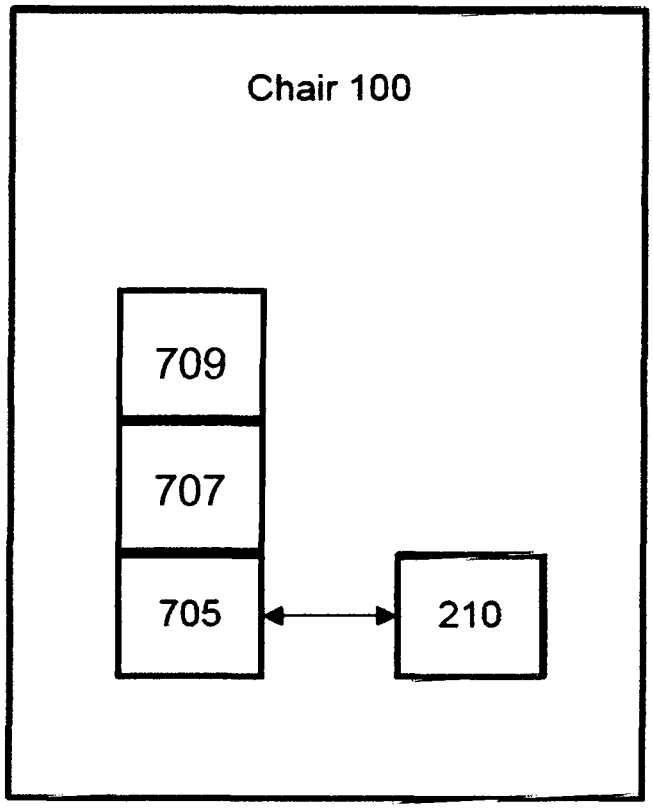
FIG. 7 shows a schematic representation of the chair.

FIG. 7 shows a schematic representation of the chair 100. As mentioned, the pump 705 is positioned inside the chair 100. The pump 705 is electrically coupled to the battery 210, which may be removably positioned inside the chair adjacent the pump 705. The chair 100 has one or more internal chambers that may be inflated with air or other gas.

Advantageously, the resilient material of which the chair 100 is manufactured is sufficiently thin and flexible that it can be folded into a relatively small size when deflated. The material is also lightweight making it easy to carry the deflated chair once folded. However, the material is sufficiently strong that it can support a person when the chair is inflated. The chair may be equipped with one or more covers that can be used to cover the chair when inflated or that can be used to cover the deflated chair.

As will be apparent to those of skill in the art upon reading this disclosure, each of the individual embodiments described and illustrated herein has discrete components and features which may be readily separated from or combined with the features of any of the other several embodiments without departing from the scope of the subject matter described herein. Any recited method can be carried out in the order of events recited or in any other order which is logically possible.

While this specification contains many specifics, these should not be construed as limitations on the scope of an invention that is claimed or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Similarly, while operations are depicted in the drawings in a particular order, this should not be understood as requiring that such operations be performed in the particular order shown or in sequential order, or that all illustrated operations be performed, to achieve desirable results.

Although embodiments of various methods and devices are described herein in detail with reference to certain versions, it should be appreciated that other versions, embodiments, methods of use, and combinations thereof are also possible. Therefore the spirit and scope of the appended claims should not be limited to the description of the embodiments contained herein.

The invention claimed is:

1. A chair system, comprising:

an inflatable body having at least one internal chamber configured to be filled with air;

a control panel on a bottom-most edge of the chair and located directly on the chair, the control panel including an actuator that can be actuated to control operation of a pump;

the pump removably positioned inside the inflatable body, the pump configured to be coupled to a battery such that the pump can be powered to inject air into the internal chamber, the pump removably coupled, via a hose, to an inflation port inside the chair so that the pump can pump air into the chair while the pump is positioned inside the chair, wherein the control panel is located on an outer surface of the chair itself and not on the pump; and the hose that removably attaches to the inflation port on the chair for injecting air into the chair wherein the hose provides a passageway for manually filling the chair with air or deflating chair;

wherein the inflatable body takes on the shape of a chair having a seat and a back when filled with air and inflated, and wherein the inflatable body is flexible such that it entirely collapses when deflated.

2. A chair system as in claim 1, further comprising the battery.

3. A chair system as in claim 2, wherein the battery is sized and shaped to fit inside the inflatable body.

4. A chair system as in claim 1, wherein the inflatable body includes a port sized and shaped to removably receive a battery.

5. A chair system as in claim 4, further comprising a door that that can be opened and closed to provide access to the port and to cover the port.

6. A chair system as in claim 1, wherein the pump operates between an off state, an inflation state, and a deflation state.

7. A chair system as in claim 1, further comprising a cover.

* * * * *